United States Patent [19]

Colli et al.

[11] Patent Number: 4,958,779

[45] Date of Patent: Sep. 25, 1990

[54] METHOD FOR RESTORING YARN CONTINUITY DURING BOBBIN WINDING, AND DEVICES FOR ITS IMPLEMENTATION

[75] Inventors: Luici Colli; Roberto Badiali; Nereo Marangone, all of Pordenone, Italy

[73] Assignee: Savio S.p.A., Pordenone, Italy

[21] Appl. No.: 246,411

[22] Filed: Sep. 19, 1988

[30] Foreign Application Priority Data

Nov. 13, 1987 [IT] Italy ..... 22622 A/87

[51] Int. Cl.[5] ..... B65H 54/22

[52] U.S. Cl. ..... 242/035.6 R

[58] Field of Search ..... 242/35.6 R, 39, 36, 242/35.5 R, 35.5 A; 57/263

[56] References Cited

U.S. PATENT DOCUMENTS

| | | | |
|---|---|---|---|
| 2,752,103 | 6/1956 | Fürst | 242/36 |
| 4,163,358 | 3/1979 | Takeuchi et al. | 57/78 |
| 4,195,790 | 4/1980 | Reiners et al. | 242/35.6 R X |
| 4,228,642 | 10/1980 | Dakin et al. | 57/263 |
| 4,232,508 | 11/1980 | Husges et al. | 57/263 X |
| 4,319,720 | 3/1982 | Ueda | 242/35.6 R |
| 4,631,682 | 12/1986 | Ng et al. | 242/36 X |
| 4,635,866 | 1/1987 | Kamp et al. | 242/39 |

FOREIGN PATENT DOCUMENTS

| | | |
|---|---|---|
| 3529663 | 4/1986 | Fed. Rep. of Germany . |
| 1323724 | 7/1973 | United Kingdom . |
| 2060003 | 4/1981 | United Kingdom . |

*Primary Examiner*—Stanley N. Gilreath

*Attorney, Agent, or Firm*—Hedman, Gibson, Costigan & Hoare

[57] ABSTRACT

A method for restoring yarn continuity during bobbin winding by means of an intervention cycle of variable duration divided into a first part for braking the bobbin and a second part for joining the yarn. Between the commencement of the two parts there is interposed a delay which varies as a function of the diameter reached by the bobbin at the moment of intervention.

22 Claims, 6 Drawing Sheets

DEVELOPMENT OF BOBBIN STOPPAGE TIMES AT DIFFERENT WINDING SPEEDS AS A FUNCTION OF THE ROTATION ANGLE OF THE BOBBIN CARRYING ARM

METHOD FOR RESTORING YARN CONTINUITY DURING BOBBIN WINDING, AND DEVICES FOR ITS IMPLEMENTATION

This application is related to commonly assigned application by Luigi Colli et al. for Improve Bobbin Method Comprising Variable Duration Intervention For Restoring Yarn Continuity And Devices For Its Implementation, Ser. No. 254,406, filed Oct. 6, 1988; Improved Bobbin Winding Method And Devices For Implementing Said Method, Ser. No. 258,372, filed Oct. 17, 1988; and High Productivity Bobbin Winding Method And Devices For Its Implementation, Ser. No. 256,776, filed Oct. 11, 1988.

FIELD OF THE INVENTION

This invention relates to an improved winding method and devices for implementing said improved winding method. The improvement according to the invention enables the productivity of the winding operation to be increased and unproductive times to be eliminated or shortened.

BACKGROUND OF THE INVENTION

The winding operation consists substantially of transferring the yarn from a starting package and winding it on a rigid tube in order to form a structure wound in the form of cross turns and known as a bobbin, and during said transfer clearing the yarn of its imperfections and defects such as lumps, groups, naps, weak points, flocks etc. Said defects are eliminated by cutting out the defective portion and joining the yarn ends.

This joint can be made either by a proper knot such as a fishermans knot or a weavers knot produced by a mechanical knotter, or by a pneumatic or friction joint in which the fibres of the cut ends are untwisted, intermixed and then retwisted to thus restore continuity to the cut yarn without introducing the hardly relevant irregularity represented by an actual knot. The removal of yarn defects is commonly known as yarn clearing in that the defect is detected by a yarn clearer which is sensitive to yarn defects and can either itself break the continuity of the yarn or operate a separate cutting member.

Any discontinuity in the yarn causes the bobbin to undergo braking so that it stops, the yarn ends are picked up by mobile suckers and moved to the joining devices or knotters, the joined yarn is returned to its normal position and winding is recommenced, the bobbin and its drive roller being driven up from rest to the operating speed, which is generally of 600–1600 m/minute. The winding speed is determined—within the limits of the possible winding machine performance—by the quality and count of the yarn to be wound.

The overall productivity of the operation is determined by the winding speed, the time taken by the overall intervention cycle and the actual number of interventions to be made.

It is therefore apparent that if a certain yarn is wound at a too high speed, the increased productivity resulting from the increase in speed is compromised by the down times deriving from the increase in the number of interventions required to restore the yarn continuity due to the greater number of yarn breakages. The bobbin is normally driven by a rotating roller—of right cylindrical or slightly tapering conical shape—which is kept in contact along a generator common to the two members.

The technical problem to which the present invention relates derives from the fact that during the winding operation the rotating roller does not change its shape or size, whereas the bobbin continually changes its size due to the increasng amount of yarn wound on it.

If the drive takes place under perfect friction, the peripheral speed of the drive roller is substantially equal to the linear winding speed of the yarn.

The yarn is guided so that it winds on the bobbin in a spiral arrangement using a yarn guide of various shapes or spiral grooves formed in the surface of the driving roller, in which the yarn engages.

By the action of such devices, the yarn is distributed over the bobbin surface by means of periodical travel along the bobbin generator.

The closer together the turns, the more dense is the bobbin and vice versa.

As the size of the bobbin increases, the linear yarn winding speed is kept substantially constant—this being a necessary condition for proper outcome of the operation—but the angular speed of the bobbin decreases linearly.

As the yarn travels along the contact generator in constant time, the number of turns wound for each travel stroke of the yarn guide reduces slightly but continuously for each wound layer.

As the bobbin forms it acquires an ever increasing inertia because of the increase in mass and its progressive distancing from the axis of rotation.

The first stage in the intervention cycle, which commences with the cutting or tearng of the yarn by the passage of the defective portion through the yarn clearer, is the braking of the bobbin so that its speed decreases to zero.

The brake must therefore absorb the kinetic energy possessed by the rotating bobbin, and its stoppage time is substantially proportional to said kinetic energy.

Generally, the bobbin is braked by a mechanical show brake—or equivalent type—operated by pressurized fluid such as compressed air, distributed by a solenoid valve which operates following the yarn discontinually signal.

The drive roller is provided with its own braking devices, such as an inverter acting on its drive motor. To prevent damage to the bobbin it is desirable that the two braking actions take place independently, by withdrawing the bobbin and roller away from each other when the yarn discontinuity signal occurs and at the commencement of the intervention cycle.

The operations subsequent to the stoppage can take place only when the bobbin is at rest.

In the known art the intervention cycle is effected as shown in the scheme of FIG. 1.

The duration of the intervention cycle is fixed and is divided into a fixed time available for stoppage and a fixed time for executing the other operations to be carried out during the intervention. After the stoppage time has passed, the bobbin must be completely at rest because otherwise the other intervention operations cannot be properly carried out, for instance it would be impossible to grip the end of the yarn on the bobbin side if this is still rotating.

The drive and control unit for the members which sequentially carry out the various operations of the intervention cycle is a mechanical system—such as a shaft provided with a series of cams so that when rotated, said cams sequentially encounter the drives for the various members, which consequently operate in sequence—or an equivalent electrical control system.

In this arrangement, the various intervention operations are performed sequentially by various members operated in accordance with a program of operation initiation times which are rigid and cannot be changed.

To be more precise, it should be noted that certain preliminary operations, such as moving the suckers into the correct position for seeking and picking up the yarn ends, these suckers being in their best position at the commencement of the intervention cycle, can commence while the bobbin is still moving, but the actual operations of the intervention cycle subsequent to braking can only commence when the bobbin is properly at rest.

If the bobbins to be produced are small or if the operating speed is low, the time taken by those preliminary operations which can be carried out while the bobbin is still moving is longer than the bobbin stoppage time, and there are therefore no problems.

The fixed time allowed for bobbin stoppage must therefore correspond to the time required for absorbing the maximum kinetic energy which the bobbin can posses, and thus to its maximum possible winding speed, its maximum possible size and its maximum possible density. This time must then be increased by a certain safety margin to take account of any reduction in the efficiency of the braking system.

The current tendency in bobbin production is to increase winding speed and to maintain it when producing large-diameter bobbins. It is apparent that the criterion of assigning a fixed available time for bobbin stoppage based on the maximum kinetic energy which it can assume leads in most cases to a considerable time wastage because this fixed assigned time is necessary only when the bobbin has reached its maximum scheduled size and rotates at the maximum speed scheduled for this size.

This is very important because this time wastage—even if only of the order of a few seconds—is repeated during every intervention cycle for restoring yarn continuity, and this cycle can take place hundreds of times.

The deriving technical problem which the present invention solves is to assign a bobbin stoppage time within the intervention cycle which is no longer fixed but is variable, and corresponds substantially to the time which the braking device would require at any given moment to bring the bobbin to rest, this time depending on the kinetic energy of the bobbin at the moment of this operation.

SUMMARY OF THE INVENTION

The present invention therefore is directed to an improved winding method and devices for its implementation. It includes three essential component parts:

dividing the intervention cycle—and the control devices which implement it—into two separate parts, a first part for at least braking and stopping the bobbin and directly related to discontinuity in the wound yarn (and hereinafter called simply braking) and a second part for at least the further stages of the intervention cycle which have to be carried out when the bobbin is at rest (and hereinafter called simply joining), and interposing between the commencement of the stages involved in the two parts a variable delay which is to be determined at any given time, and is implemented by a timer device which controls the commencement of joining with a time displacement corresponding to said delay;

measuring the state of progress in the formation of the bobbin and transmitting this to the unit for identifying the delay to be assigned;

identifying the delay to be assigned at any given time on the basis of the state of progress in the formation of the bobbin—and transmitting this to the timer device which implements this delay between the commencement of braking and the commencement of joining.

DESCRIPTION OF THE PREFERRED EMBODIMENT

Before describing in detail the three aforesaid essential parts of the invention, some introductory considerations are necessary. Mechanical bobbin braking systems exert a practically constant braking torque as the speed varies, and consequently the time required to halt the bobbin is essentially proportional to the bobbin kinetic energy.

The time required for stopping the bobbin is therefore unequivocally determined by its state of progress—once the braking torque of the braking device is known.

The bobbin stoppage time, and the kinetic energy which it possesses, depend therefore both on initially assigned parameters, namely;

yarn count
initial tube size
manner in which the yarn guide undergoes its travel strokes
peripheral speed of the drive roller (which is substantially equal to the linear winding speed), which do not vary as the bobbin progresses, and also on the actual bobbin progress itself.

The bobbin progress can be measured with reference to various parameters such as the number of revolutions made by the drive roller from the commencement of bobbin formation or the useful time which has passed from said commencement, using a revolution counter or a time counter respectively.

Figure 1:
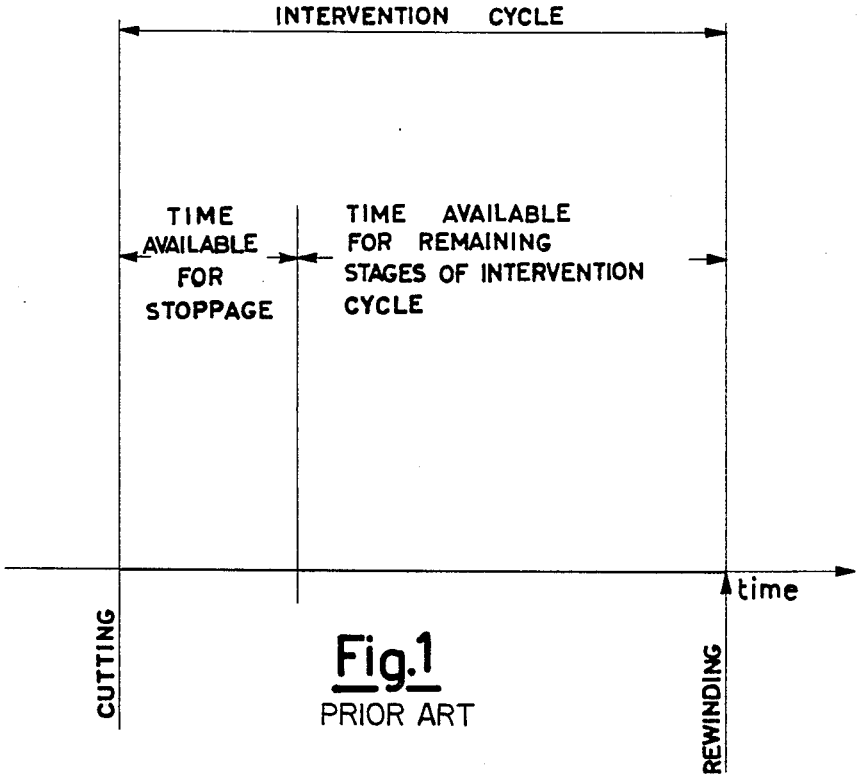
Fig.1 PRIOR ART
FIG. 1 is a graphical illustration of the prior art.
Figure 3:
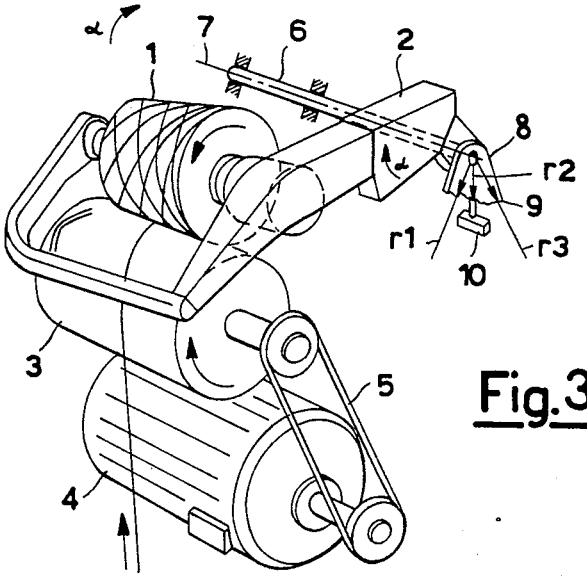
FIG. 3 is an orthogonal representation of the arrangement of the bobbin carrier arm and the drive roller.

In contrast, the present invention is based on measuring the bobbin progress by the angular displacement of the bobbin carrier arm. This method of measurement is described with reference to FIG. 3, which diagrammatically shows the arrangement of the bobbin carrier arm.

The bobbin 1 under formation, the tube of which is engaged between the fixing centres of the bobbin carrier arm 2, rests against the roller 3 which rotates at constant speed driven by the motor 4 by way of toothed belt drive 5. The bobbin 1 is therefore rotated by the roller 3 and winds the yarn about itself, its diameter gradually increasing.

The effect of this increase is that the rotation axis of the fixing centres engaged in the tube of the bobbin under formation moves further from the roller 3, and with it the bobbin carrier arm rises upwards to move from the lower position when the tube is empty to an upper position which continues upwards as the bobbin grows.

Figure 2:
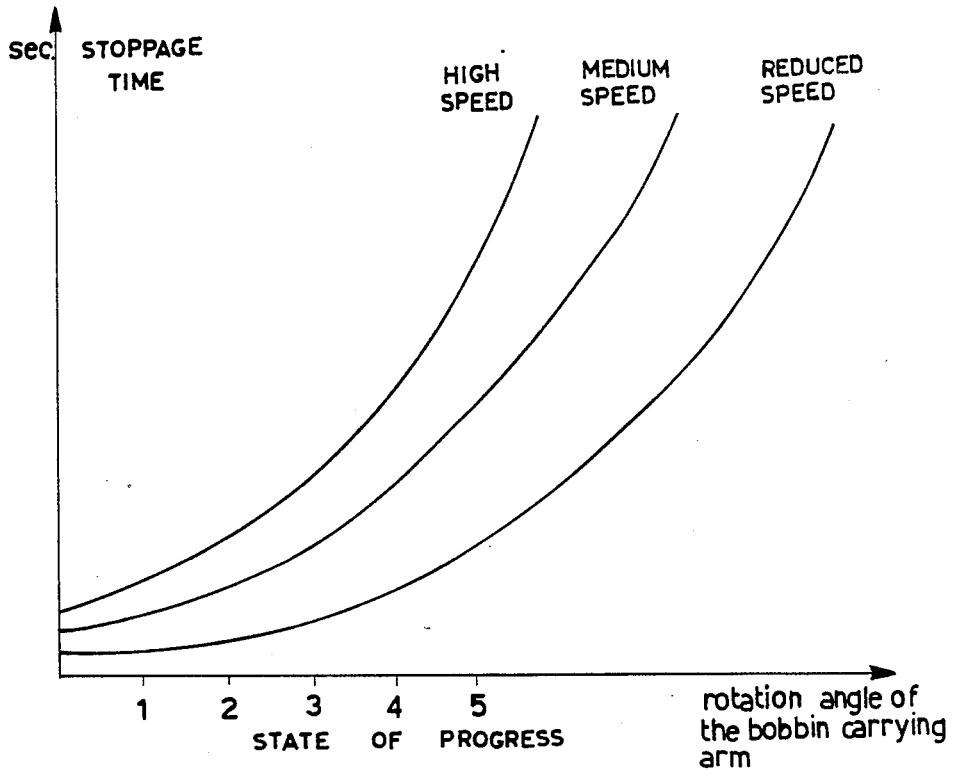
FIG. 2 is a graphical representation of bobbin stoppage times relative to the amount of yarn on the bobbin.

The bobbin carrier arm is hinged on the shaft 6 and rotates about its axis through an angle $\alpha$ in the vertical plane. Measuring the value of $\alpha$ provides an indication of the state of progress of the bobbin, this being substantially equivalent to measuring its radius and therefore its volume, and is independent of the wound yarn count and represents an advantageous simplification by eliminating the most variable of the parameters. The variation in the time required for stopping the bobbin as a function of the bobbin state of progress is shown in FIG. 2. Once the aforesaid winding parameters are known, this variation can be determined with good approximation and provides a reliable indication of the stoppage times for the bobbin under formation. The characteristics of the three essential parts of the present invention will now be described, commencing from the division of the intervention cycle and its control devices.

The first part of the intervention cycle, which commences on receipt of a signal indicating yarn discontinuity—either because it has been cut intentionally by the yarn clearer, or because it has broken naturally or because the feed package is empty—consists of the following main stages:

raising the bobbin away from the drive drum
braking the bobbin
braking the drive roller.

All these three operations are related to each other and are controlled either electrically, for example by means of a solenoid valve operating with compressed air, or mechanically by means of a rotary shaft provided with cams. The various operations concerned and the devices which implement them proceed without rigid time relationship with the second part of the intervention cycle. The second part of the intervention cycle can commence either simultaneously with the first—if no delay instruction has been transmitted by the delay identification unit—or with a delay in accordance with the instructions from said delay identification unit. The second part of the intervention cycle consists of the following main stages:

moving the suckers which seize the yarn ends on the bobbin side and package side;
sensing the presence of yarn;
if there is no yarn present on the package side, operating the package changing devices and, when the package has been changed, seizing the new yarn end on the package side;
disenabling the command which has implemented the first part of the cycle: the brakes are released, and the bobbin and roller are again brought into contact;
reversing the motion of the drive roller for a short time to allow the sucker which seizes the yarn end on the bobbin side to operate with a sufficient length of yarn to reach the knotter;
inserting the yarn ends into the knotter;
operating the knotter to make the joint and then release the joined yarn (in the meantime the yarn seizing suckers can return to their rest position);
restarting the drive roller.

These stages of the second part can also be controlled mechanically, for instance by a rotary shaft provided with a series of cams which gradually operate the controls for the devices implementing the aforesaid steps, or by equivalent electrical or electronic devices.

Measuring the state of progress of the bobbin under formation is done as follows. The variation in the angle $\alpha$ can be measured for example by means of an adjustable cam 8 mounted rigidly on the bobbin carrier arm 2.

The outer contour 9 of the cam 8 is in the form of several portions of constant radius $r_1, r_2, \ldots$ separatd by smooth connection portions of increasing radius, to form a step pattern. As the angle $\alpha$ increases, the cam 8 rotates rigidly with the arm 2 and by means of its outer contour 9—which is in contact with a microsensor 10—it operates said sensor 10 to provide a pulse for each change in radius of the contour 9.

According to a further embodiment the cam 8 can have a contour 9 of continously increasing radius. As the angle $\alpha$ increases, the sensor 10 is continously and progressively displaced, and the measurement of the angle $\alpha$ is represented by a measurement of the physical movement of the sensor 10.

The identification of the delay to be assigned is determined in the following manner.

It will be assumed that a progressively increasing series of times are to be left available for bobbin stoppage.

For example, the following time series can be set:

2 seconds (not less than the time occupied by the preliminary operations which can be carried out while the bobbin is still moving),
3 seconds corresponding to a delay of 1 seconds,
4 seconds corresponding to a delay of 2 seconds, and so on.

This series of times, or delays, is set as a series of times to be assigned by the identification unit.

It is apparent that the more the contour 9 of the cam 8 is divided into different radius portions, and the more numerous and close together the terms of the increasing time series are, the greater is the approximation between the time left available for stoppage and the actual time required for the bobbin to stop at any given moment.

Figure 4:
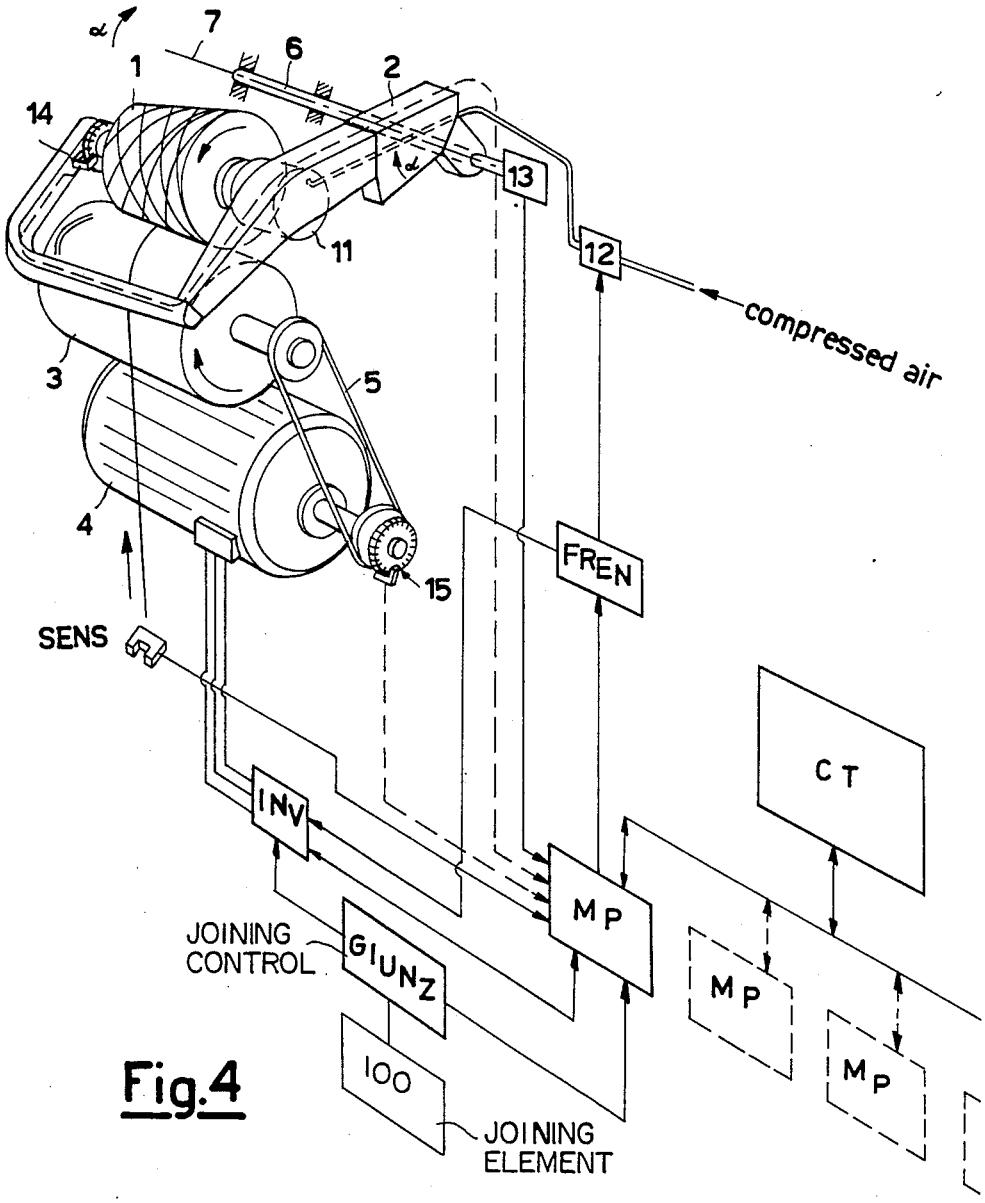
FIG. 4 is an orthogonal representation of the present invention including the control signal of the microprocessor.

This series of times to be left available for bobbin stoppage is fed into the memory of the processor on the winding machine. The characteristics and advantages of the present invention will be more apparent from the description of a typical embodiment given hereinafter with reference to FIGS. 4, 5 and 6.

It should be noted that the progressive increase in the radius of the bobbin under formation can be measured either by measuring the increase in the angle $\alpha$ or by measuring the ratio of the speed of rotation of the drive roller to that of the bobbin, or by measuring the instances ratio of the respective total number of revolutions made.

The bobbin carrier arm 2 carries in its fixings centres a mechanical brake 11 operated pneumatically by compressed air by means of the solenoid valve 12. The bobbin carrier arm is hinged on the shaft 6 and rotates about its axis 7 through an angle $\alpha$ in the vertical plane.

The progress in the bobbin radius is measured by the measuring device 13 which measures the angle $\alpha$ or alternatively by the sensors 14 and 15 which provide pulses for measuring the total number of revolutions undergone or the speed of the bobbin and drive roller respectively.

This measurement of the bobbin state of progress must be made before starting braking.

Each winding station—commonly known as the winding head or simply head—is provided with a microprocessor MP connected to the machine processor or head computer CT; said microprocessor is connected to the following: to the brake control FREN which operates the brake 11 by the solenoid valve 12 and operates the other members which implement the braking cycle; to the sensor 13, from which it obtains the bobbin radius by measuring the angle—or alternatively to the sensors 14 and 15 from which it obtains the bobbin radius by means of the instantaneous ratio of the respective number of revolutions or speed—; to the yarn sensor SENS which—when it detects a yarn discontinuity—feeds to MP the intervention cycle intitiation signal; to the inverter INV to which it feeds stop and start signals for the motor 4 and thus for the roller 3; and to joining control GIUNZ which sequentially activates the various members which implement the joining cycle by means of joining element 100 and removes the brake applied to the motor by the inverter. The delays with which GIUNZ is activated are determined by a timer device incorporated in the microprocessor MP but not indicated on the figure.

Figure 5:
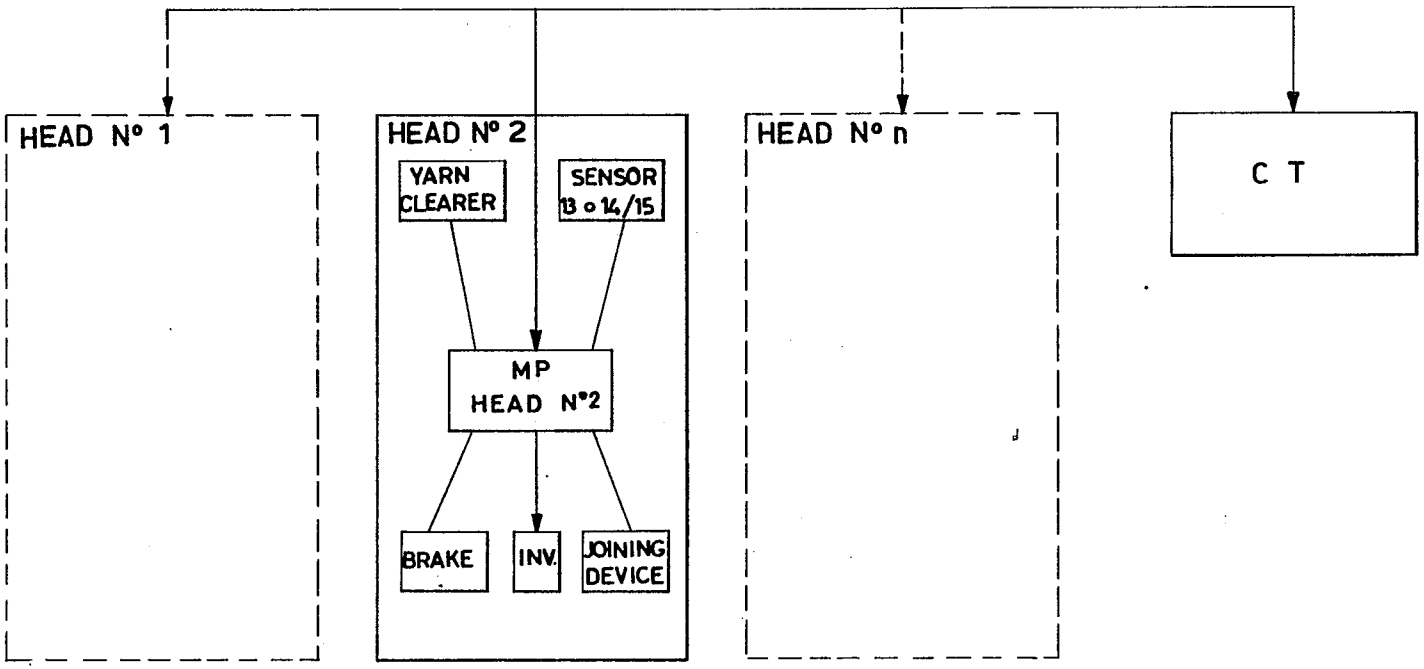
FIG. 5 is a diagrammatic depiction of the logic circuit.

This scheme is shown in FIG. 5.

The CT memories contain the parameters for the delays $\Delta t_1$, $\Delta t_2$ . . . as a function of the bobbin diameter (or radius) $\phi lim_1$, $\phi lim_2$, . . . according to the curve of FIG. 2.

Figure 6:
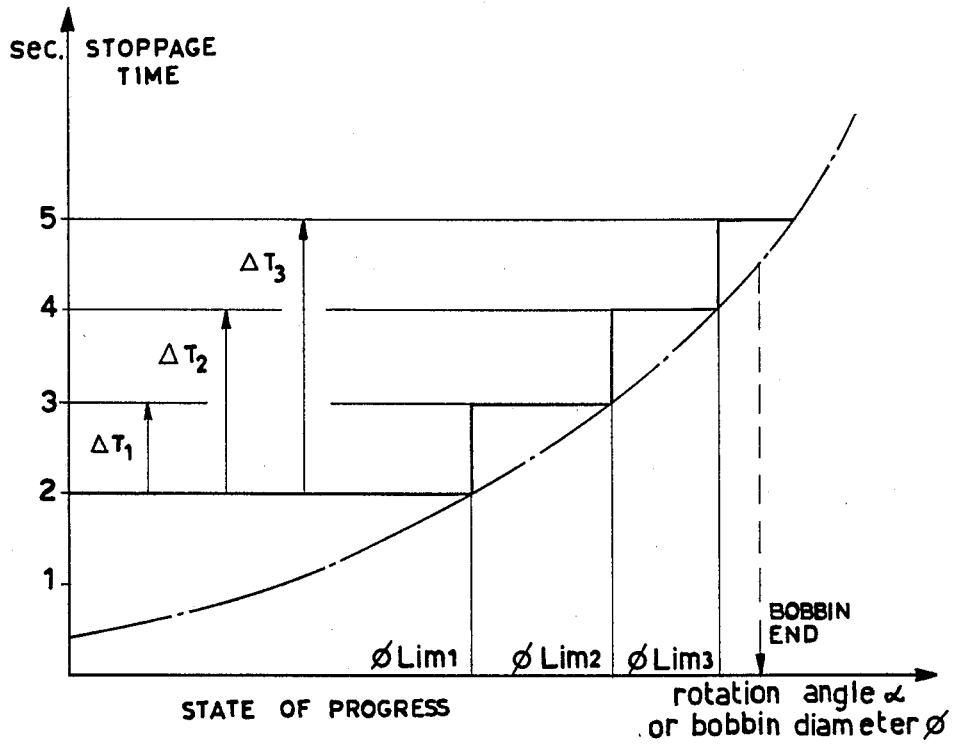
FIG. 6 is a graphical representation of the function of stoppage times relative to bobbin diameter.

These $\phi lim$ values can be calculated or determined on sample bobbins and are a function of the aforesaid winding parameters in accordance with FIG. 6. A series of limiting diameters corresponds to the series of times indicated heretofore by way of example.

When the bobbin diameter exceeds the value $\phi lim_1$, the time of 2 seconds available for stoppage is no longer sufficient and it is necessary to increase this time by a delay $\Delta t_1$ equal to 1 second, so leaving 3 seconds available instead of 2 seconds and so on. A series of pairs of values $\phi lim_1/\Delta t_1$, $\phi lim_2/\Delta t_2$, $\phi lim_3/\Delta t_3$ . . . *is therefore obtained.*

Figure 7:
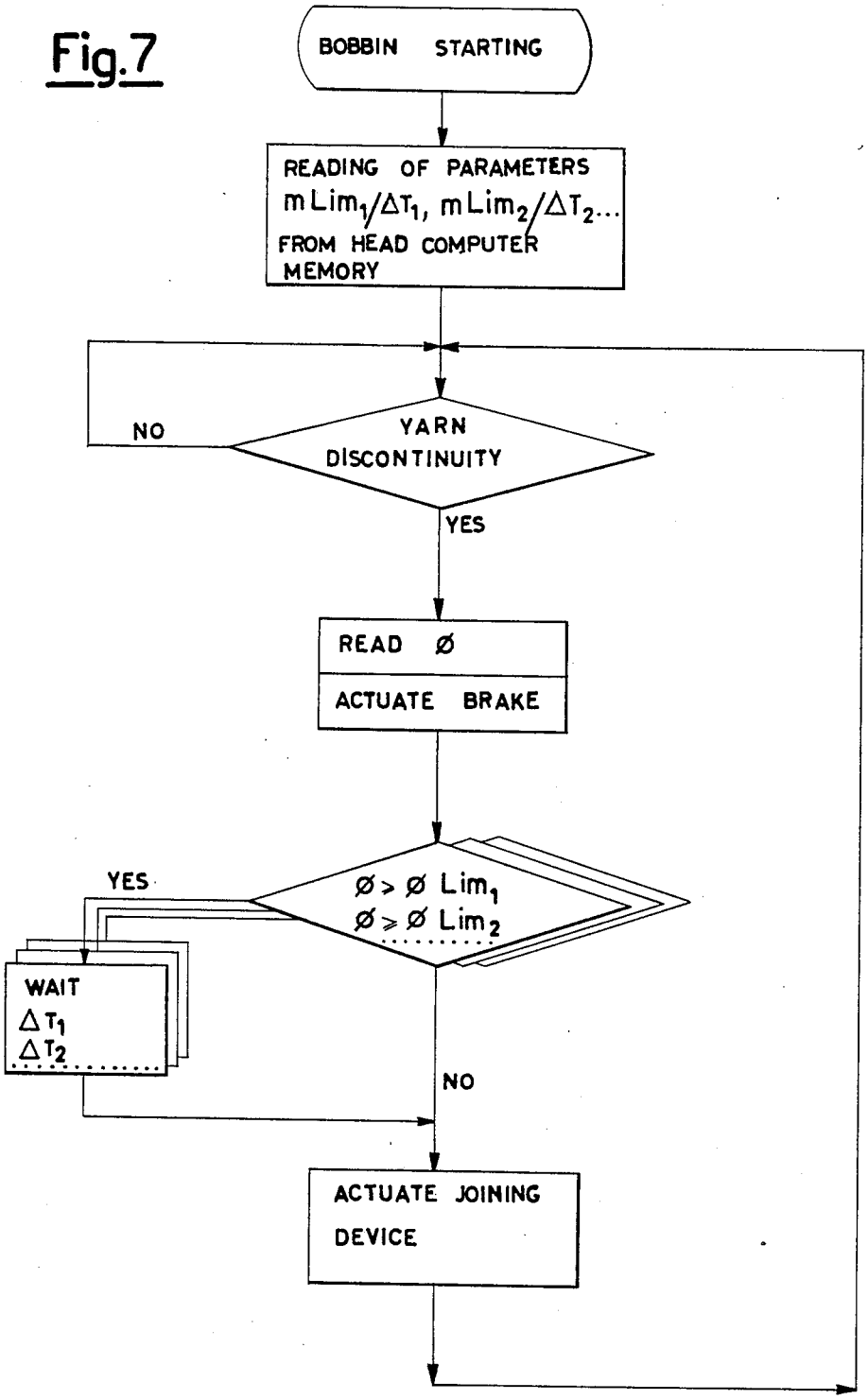
FIG. 7 is a diagram of the control logic of the present invention.

The use of safety margins corresponds to displacing the stepped line thus constructed to the left and reducing the $\phi lim$ values. With reference to FIG. 7, which shows the logic scheme for the method, the commands are executed in the following succession.

At each commencement of formation of a new bobbin, the microprocessor of the winding head concerned reads the series of values $\phi lim/\Delta t$.

At each yarn discontinuity the bobbin/roller assembly is braked, each independently by its own brake, and the diameter reached by the bobbin is measured. This value is confronted in sequence with the series of values $\phi lim_1$, $\phi lim_2$. . . to find the minimum value of $\phi lim$ which still exceeds the measured $\phi$, and the corresponding delay $\Delta t$ is used. This delay instruction is fed to the timer device.

The microprocessor is not required to compute but only to make a series of comparisons between the diameter measured at the moment of the break in continuity of the yarn and the memorised series of $\phi lim$ values.

Up to this point in the description we have for simplicity described an embodiment based on the operating criterion of fixing the increasing terms of the series of times left available for braking the bobbin—or of the corresponding series of delays between the commencement of braking and the commencement of joining—but varying, in accordance with the bobbin winding parameters, the series of limiting states progress beyond which the delay has to be incremented by a predetermined step. Thus in the diagram of FIG. 6 a staircase arrangement is obtained with its steps having fixed "rise" values and variable "tread" values.

For correct understanding of the invention it should however be noted that this can also be attained by the opposite operating criterion. This consists of fixing the series of limiting state of progresss values beyond which the time allowed for braking—or the delay between the commencement of braking and the commencement of joining—as to be incremented, but varying the terms of the increasing series of times left available for braking—or of the corresponding series of delays.

Thus in the diagram of FIG. 6 a staircase arrangement is obtained with its steps having fixed "tread" values and variable "rise" values.

The advantages obtained by the present inventionn are apparent from the aforegoing description, namely:

- the possibility of varying the time left available for bobbin braking means that winding can proceed at higher speeds and/or larger diameter bobbins can be wound without extending said braking time beyond that strictly necessary;
- any effieciency loss in the bobbin brakes with the passing of time can be compensated by varying the series of $\phi lim$ values and/or the series of times available for stoppage;
- the winding speed and/or the diameter of the bobbins produced can be varied without modifying the machin, but merely by modifying the data stored in the machine processor memories;
- the ability to ignore the yarn count in determining the time required for braking represents a simplification.

We claim:

1. A method for winding yarn onto a rotating bobbin driven by a drive roller and supported by a carrier arm when the yarn feed is broken, comprising:

(a) restoring the broken yarn feed by means of an intervention cycle wherein said cycle has a first portion and a second portion wherein said first portion comprises the steps of:

(1) raising the rotating bobbin from the drive roller when the yarn feed is broken;

(2) braking the rotating bobbin and the drive roller independently until the bobbin stops rotating wherein the rotating bobbin is braked when it is raised from the drive roller; and wherein said second portion comprises joining the broken yarn; and (b) interposing a variable time delay between the commencement of said bobbin braking step of said first portion and the commencement of said joining step of said second portion of said intervention cycle by means of a timer device wherein said variable time delay is determined by the amount of yarn wound on the bobbin, wherein the amount of yarn wound on the bobbin is determined by; measuring the diameter of the bobbin by measuring the angular displacement of the carrier arm.

2. The method of claim 13 further comprising:

(a) comparing the diameter of the bobbin with a series a delay limiting values by means of a control unit; and (b) sending a delay value to said timer device by means of said control unit.

3. The method of claim 2 further comprising interposing a discrete time interval delay between said first portion and said portion of said intervention cycle which is selected from an increasing series of discrete time interval values of means of said timer device.

4. The method of claim 3 wherein zero is the first value of said series of discrete time interval delays.

5. A device for winding yarn onto a rotating bobbin driven by a drive roller and supported by a carrier arm when yarn feed is broken comprising:

(a) a bobbin raising means for raising the rotating bobbin from the drive roller when the yarn feed is broken;

(b) a bobbin braking means for braking the rotating bobbin when it is raised from the drive roller until the bobbin stops rotating;

(c) a drive roller braking means for braking the drive roller independently from said bobbin braking means;

(d) a joining means to join the broken yarn;

(e) a timer device for interposing a variable time delay between the commencement of the operation of said bobbin braking means and the commencment of the operation of said joining means wherein said time delay is determined by the amount of yarn wound on the bobbin wherein the amount of yarn wound on the bobbin is determined by a first bobbin diameter measuring means which measures the bobbin diameter by measuring the angular displacement of the carrier arm.

6. The device of claim 5 further comprising:

(a) a cam having a contour with an outer increasing radius wherein said cam is mounted rigidly on the carrier arm; and (b) sensor in contact with said contour of said cam for measuring the angular displacement of the carrier arm.

7. The device of claim 6 wherein said contour of said cam further comprises:

(a) portions of constant radius;

(b) portions of increasing radius separating said portions of constant radius for creating a stepped arrangement of provide pulses to said sensor as the bobbin increases in diameter.

8. The device of claim 6 wherein said contour of said cam has an increasing radius and said sensor is progressively displaced as the diameter of the bobbin increases.

9. The device of claim 8 further comprising controller linked together for controlling said bobbin raising means, said bobbin braking means, and said drive roller braking means wherein said controllers comprise:

(a) a first controller for determining the amount of yarn wound on the bobbin;

(b) a second controller for raising the bobbin away from the drive roller;

(c) a third controller for braking the bobbin;

(d) a fourth controller for braking the drive roller.

10. The device of claim 9 further comprising a microprocessor which compares the diameter of the bobbin with a series of preset delay limiting values for interposing said variable time delay by setting said time delay value at the lowest value greater than the measured diameter.

11. The device of claim 10 wherein said series of delay limiting values is modified by a computer which sends said time delay to said microprocessor.

12. A method for winding yarn onto a rotating bobbin driven by a drive roller and supported by a carrier arm when the yarn feed is broken, comprising:

(a) restoring the broken yarn feed by means of an intervention cycle wherein said cycle has a first portion and a second portion wherein said first portion comprises the steps of:

(1) raising the rotating bobbin from the drive roller when the yarn feed is broken;

(2) braking the rotating bobbin and the drive roller independently until the bobbin stops rotating wherein the rotating bobbin is braked when it is raised from the drive roller; and wherein said second portion comprises joining the broken yarn; and (b) interposing a variable time delay between the commencement of said bobbin braking step of said first portion and the commencement of said joining step of said second portion of said intervention cycle by means of a timer device wherein said variable time delay is determined by the amount of yarn wound on the bobbin, wherein the amount of yarn wound on the bobbin is determined by measuring the diameter of the bobbin by measuring the instantaneous ratio of the angular speed of the rotating bobbin to the angular speed of the drive roller.

13. The method of claim 12 further comprising:

(a) comparing the diameter of the bobbin with a series of delay limiting values by means of a control unit; and (b) sending a delay value to said timer device by means of said control unit.

14. The method of claim 13 further comprising interposing a discrete time interval delay between said first portion and said second portion of said intervention cycle which is selected from an increasing series of discrete time interval values by means of said timer device.

15. The method of claim 14 wherein zero is the first value of said series discrete time interval delays.

16. A device for winding yarn onto a rotating bobbin driven by a drive roller and supported by a carrier arm when yarn feed is broken, comprising:

(a) a bobbin raising means for raising the rotating bobbin from the drive roller when the yarn feed is broken;

(b) a bobbin braking means for braking the rotating bobbin when it is raised from the drive roller until the bobbin steps rotating;

(c) a drive roller braking means for braking the drive roller independently from said bobbin braking means;

(d) a joining means to join the broken yarn;

(e) a timer device for interposing a variable time delay between the commencement of the operation of said bobbin braking means and the commencement of the operation of said joining means wherein said time delay is determined by the amount of yarn wound on the bobbin wherein the amount of yarn wound on the bobbin is determined by a second bobbin diameter measuring means which measures the bobbin diameter by measuring the instantaneous ratio of the angular speed of the rotating bobbin to the angular speed of the drive roller.

17. The device of claim 16 further comprising:

(a) a cam having a contour with an outer increasing radius wherein said cam is mounted rigidly on the carrier arm; and (b) a sensor in contact with said contour of said cam for measuring the angular displacement of the carrier arm.

18. The device of claim 17 wherein said contour of said cam further comprises:

(a) portions of constant radius;

(b) portions of increasing radius separating said portions of constant radius for creating a stepped arrangement to provide pulses to said sensor as the bobbin increases in diameter.

19. The device of claim 17 wherein said contour of said cam has an increasing radius and said sensor is progressively displaced as the diameter of the bobbin increases.

20. The device of claim 18 further comprising controllers linked together for controlling said bobbin raising means, bobbin braking means and the drive roller braking means wherein said controllers comprise:

(a) a first controller for determining the amount of yarn wound on the bobbin;

(b) a second controller for raising the bobbin from the drive roller;

(c) a third controller for braking the bobbin; and (d) a fourth controller for braking the drive roller.

21. The device of claim 20 further comprising a microprocessor which comprises the diameter of the bobbin with a series of preset delay limiting values for interposing said variable time delay by setting said time delay value at the lowest value greater than the measured diameter.

22. The device of claim 21 wherein said series of delay limiting values is modified by a computer. which sends said time delay to said microprocessor.

* * * * *